US006152221A

United States Patent [19]

Carmichael et al.

[11] Patent Number: 6,152,221

[45] Date of Patent: Nov. 28, 2000

[54] APPARATUS WITH RETRACTABLE CLEANING MEMBERS

[75] Inventors: Mark Carmichael, Aboyne; Paul Howlett, Aberdeen, both of United Kingdom

[73] Assignee: Specialised Petroleum Services Limited, Westhill, United Kingdom

[21] Appl. No.: 09/377,166

[22] Filed: Aug. 19, 1999

[30] Foreign Application Priority Data

Feb. 8, 1999 [GB] United Kingdom ..... 9902595

[51] Int. Cl.[7] ..... E21B 37/02; B08B 9/00

[52] U.S. Cl. ..... 166/174; 15/104.16

[58] Field of Search ..... 166/170, 172, 166/173, 174; 175/263, 266, 267, 269, 285, 292; 15/104.16–104.19, 104.061, 104.2

[56] References Cited

U.S. PATENT DOCUMENTS 2,203,966 6/1940 Otis ..... 166/18
2,216,674 10/1940 Miller et al. ..... 166/18
5,351,758 10/1994 Henderson et al. ..... 166/174
5,947,203 11/1999 Brown ..... 166/173

FOREIGN PATENT DOCUMENTS 2272923 6/1994 United Kingdom .
2299599 10/1996 United Kingdom .

*Primary Examiner*—David Bagnell
*Assistant Examiner*—Jennifer R. Dougherty
*Attorney, Agent, or Firm*—Fleshner & Kim, LLP

[57] ABSTRACT

Apparatus for cleaning the inside walls of a pipeline, well casing or other tubing, comprises a supporting structure upon which are supported one or more cleaning members, and retraction means for controllably retracting the cleaning members so as to avoid their contact with the aforesaid tubing when desired. The apparatus is also provided with a sleeve to effect contact between the retractable cleaning members and the pipeline, well casing or other tubing. Typically, the apparatus is provided in the form of a well cleanup tool.

5 Claims, 2 Drawing Sheets

APPARATUS WITH RETRACTABLE CLEANING MEMBERS

This invention relates to well cleaning apparatus and, more generally, to apparatus used for the cleaning of the insides of pipes, tubes, liners and the like.

It is considered desirable when drilling for oil or gas to maintain a clean interior in the casing or liner of the drilling well. For this purpose, well cleaning apparatus is well known and comes in a variety of different forms. One such type of well cleaning apparatus is a casing scraper. This type of tool typically incorporates steel casing scraper blades that scrape the inside of the casing or tubing in the well. The steel blades provided with casing scrapers usually are designed to clean the casing interior of relatively large particles or debris, such as lumps of cement, rocks or congealed mud and so on.

Examples of casing scrapers can be seen from the prior art drawing attached hereto.

A second type of well cleaning apparatus known in the art may be more accurately likened to a brush and incorporates cleaning pads with protruding bristles. In British Patent Application Number 2 299 599 there is described well cleaning apparatus which has a body member to which is attached, preferably, a plurality of cleaning pads spaced circumferentially around the body member. The pads are provided with bristles on their outer face and are biased outwardly by coil springs or similar means in an attempt to maintain a sufficient contact pressure of the bristles on the interior wall of the casing.

Brushing tools are generally used to clean well casings, tubing and the like of smaller debris and or particles than that of scraper tools. Sometimes brushing tools will be used after a scraping tool has been run. Brushing tools may be used to remove oxidation lumps, scale and burrs for example.

A yet further type of well cleanup tool is generally known as a circulation tool. An example of such may be seen in our British Patent Number GB 2 272 923. The tool is generally tubular and has two outlets at separated axial positions to enable circulation of fluids to separate regions in a borehole. The drilling fluid may then be filtered and processed to further clean the well.

The existence of these and other well cleanup tools demonstrates the importance of creating a clean well, free of undesirable debris or other matter or pollutants.

However, in the present invention it is recognised that during the extraction of known cleanup tools from the well, additional debris can be dislodged, such as from the wall of the casing, thereby negating much of the cleaning work already performed. In fact, the dislodgement of debris or particles during the extraction of the tool can render futile the processes of filtering and fine-screening that may have gone before. This problem is particularly prevalent as such cleanup tools, known to the art, have their cleaning members biased outwardly to ensure adequate pressure of the cleaning members on the walls of the casing or liner. While this is of assistance during the cleaning process, it is a disadvantage during the extraction of the tool from the well.

An object of the present invention is to obviate or at least mitigate this problem associated with known clean up tools and their use.

According to the present invention there is provided apparatus for cleaning the inside walls of a pipeline, well casing or other tubing, comprising a supporting structure upon which are supported one or more cleaning members, wherein the apparatus further comprises retraction means for controllably retracting the cleaning members so as to avoid their contact with the aforesaid tubing when desired.

Typically, the apparatus is a well cleanup tool and the cleaning members are brushes or scraping blades.

The supporting structure may comprise a generally elongated body member attachable to a work string or the like. It may include one or more cleaning pads supporting the cleaning members.

The retraction means may involve the relative axial movement of two elements or portions of the apparatus by mechanical or hydraulic means.

More particularly, the retraction means may comprise an expandable split sleeve moveable between a first position on the supporting structure and a second position on the supporting structure, wherein the one or more cleaning members are connected to the sleeve, wherein also a shoulder is provided on the supporting structure at the second position which serves to radially expand the sleeve when the sleeve is located thereon such that the one or more cleaning members, in use, contact the tubing, and wherein the sleeve is not so expanded when in the first position such that the one or more cleaning members do not contact the tubing.

Hydraulic or mechanical means may be provided to controllably move the sleeve from the first position to the second position and from the second position to the first position.

Alternatively, the supporting structure and shoulder thereon may be moveable relative to the sleeve during the picking up of the tool. Preferably, this would cause the sleeve to move from the second position to the first position.

Locking means may be provided for locking the sleeve in the first or second position. More generally, locking means may be provided for locking the one or more cleaning members in a retracted or radially expanded state.

In order to provide a better understanding of the invention, an embodiment thereof will now be described, by way of example only, and with reference to the accompanying Figures, in which.

Figure 1:
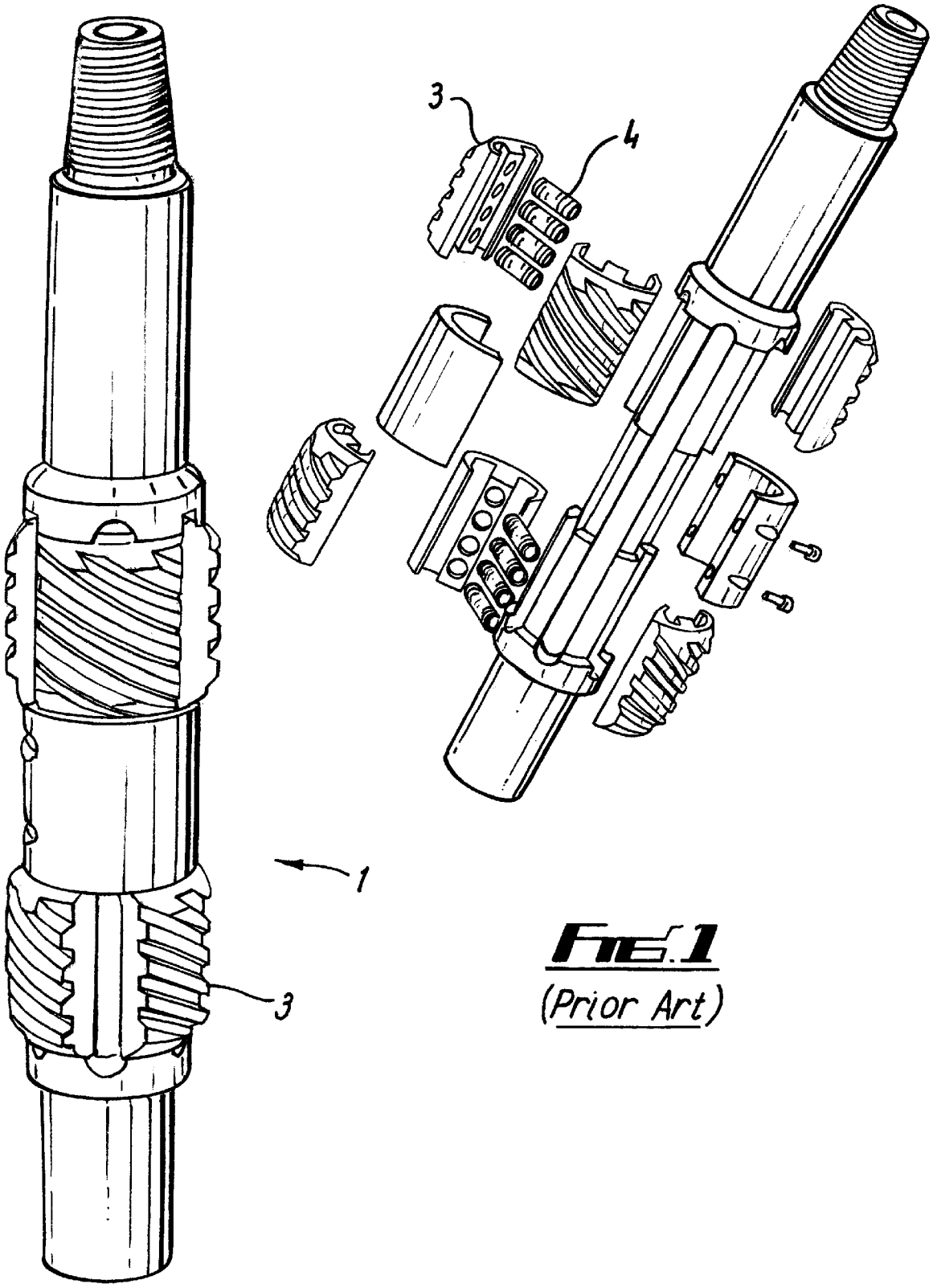
FIG. 1 (Prior Art)
FIG. 1 shows a casing scraper forming prior art.

Referring firstly to FIG. 1, two representations of a known well cleanup tool are shown. The tool 1 is designed as a casing scraper and includes scraper blades 3 that are biased in an outward or radial direction by the springs 4. In use, the blades 3 are maintained in contact with a casing wall in a downhole well or environment.

Figure 2:
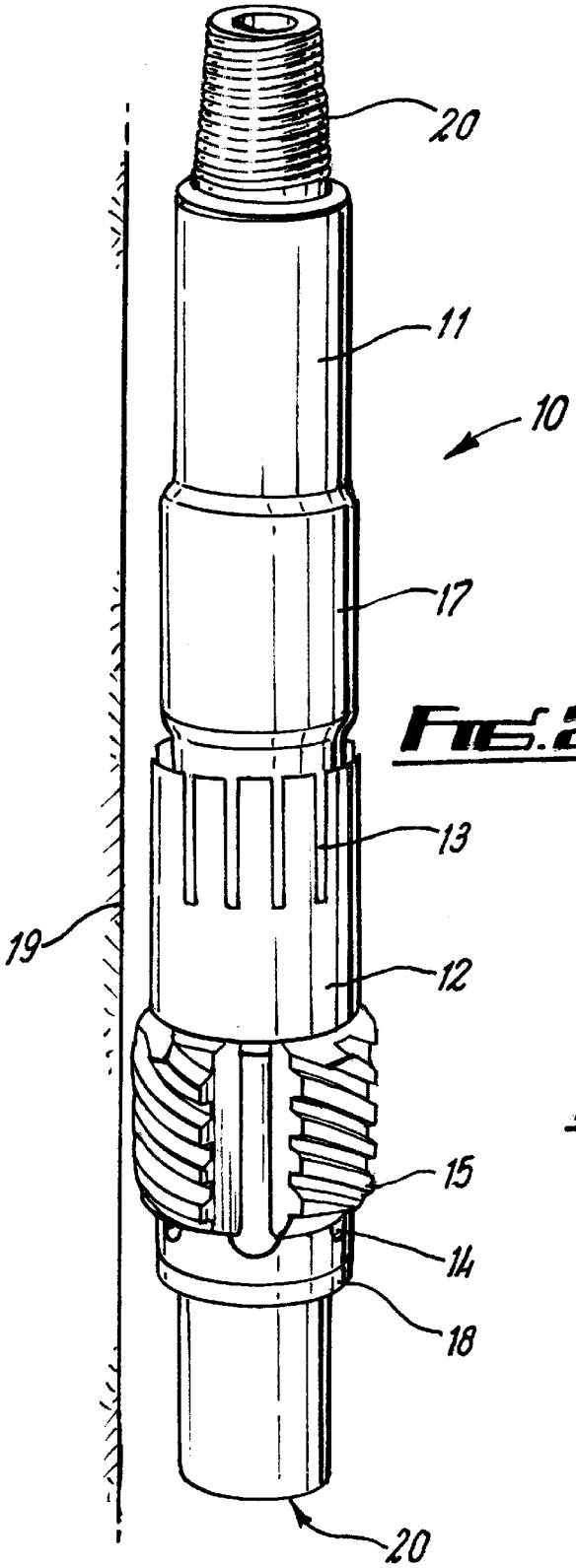
FIG. 2 illustrates a well cleanup tool having retractable cleaning members in accordance with the invention.

In FIG. 2 an alternative tool is depicted and generally described at 10. The tool 10 comprises a substantially cylindrical and elongate supporting structure or body 11 having means 20 at each end for attachment to a drill string. Upon the supporting structure 11 is slideably mounted a sleeve 12. The sleeve 12 is expandable by reason of longitudinal slits 13 located along part of its length.

A plurality of cleaning pads 14 are detachably fixed to the sleeve 12, the pads 14 supporting cleaning members in the form of blades 15. Coil springs (not shown) are located behind or internally of the pads 14 to bias the pads 14 and consequently the cleaning members 15 in an outward and radial direction.

The supporting structure 11 is provided with a shoulder 17 having an increased outside diameter. The shoulder 17 is located at what is referred to herein as the second position.

In FIG. 2, the sleeve 12 is located at the first position and abuts bearings 18. The bearing 18 provides a shoulder on the supporting structure 11, preventing movement of the sleeve 12 further down the tool or drill string.

When the sleeve 12 is in the first position the blades 15 are close to but do not quite reach or contact the casing wall 19 (shown in half section). Thus, any springs or other biasing means which bias the cleaning members 15 in an outward radial direction are limited in that they do not allow for sufficient radial extension of the cleaning members 15 to contact the wall 19 while the sleeve 12 is in the first position.

In the embodiment hydraulic means may be employed to cause upward or axial movement of the sleeve 12 relative to the supporting structure 11. This movement of the sleeve 12 causes it to straddle the shoulder 17 and consequently expand outwardly, causing the scraper blades 15 to come into contact with the wall 19.

In an alternative embodiment the sleeve 12 could be mechanically or hydraulically locked in the first or second position during, for example, a specific operation. For example, a J-slot mechanism, well known to the art, could be used to fix the sleeve in a desired position.

Figure 3:
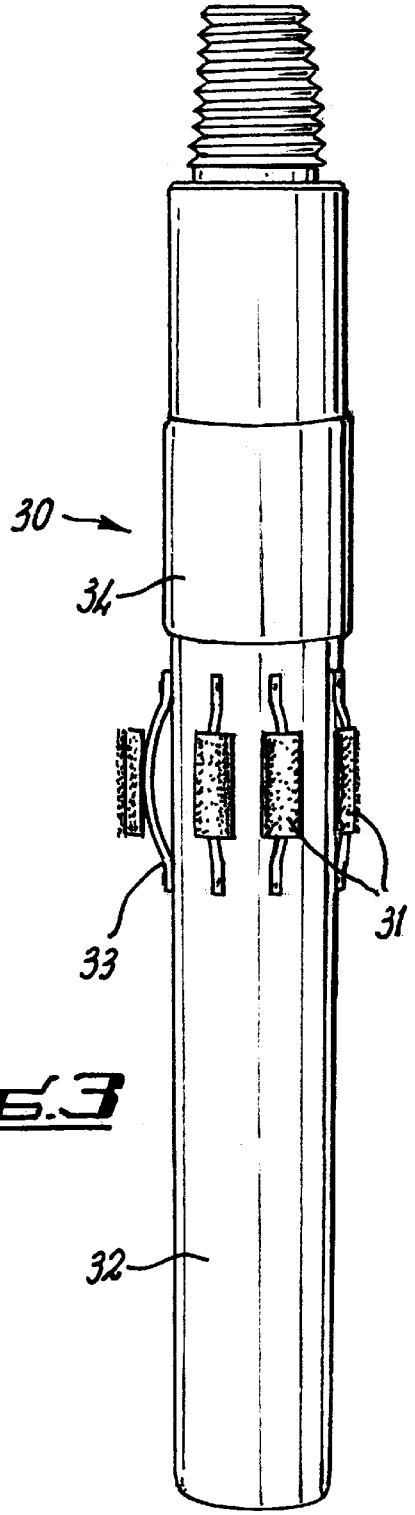
FIG. 3 shows an alternative tool, also having retractable cleaning members.

In FIG. 3, a tool 30 has brushes 31 mounted on a supporting structure 32 by leaf springs 33. The springs 33 bias the brushes in an outward and radial direction, such that in normal use they extend radially to contact the inside wall of tubing or pipework in which the tool 30 is located.

Again slideably mounted on the supporting structure 32 is a sleeve 34. The sleeve is sized such that it may at least partially envelope and compress the springs 33 so as to cause the brushes 31 to retract until they no longer contact the tubing wall.

A distinguishing feature between the embodiments of FIG. 2 and FIG. 3 is that the sleeve in this latter described embodiment is not itself expandable or retractable, and nor does it support the cleaning members.

The advantage of the tools or apparatus described is that the cleaning members can be raised or lowered in the well without scraping or brushing the casing wall, if desired.

While well cleanup tools have been described by way of example, it should be understood that the present invention is not limited to such tools or such applications. For example, the invention could be applied to pipeline pigs. Moreover, the invention could be applied to drilling tools other than well cleanup tools, in situations where it may be desired to withdraw a tool or sub from a well without it scraping against or interfering with the well liner or casing or packers or the like engaged with such.

Further modifications and improvements may be incorporated without departing from the scope of the invention herein intended.

What is claimed is:

1. An apparatus for cleaning insides of a pipeline or well casing, comprising:

supporting structure upon which are supported one or more cleaning members; and retraction means for controllably retracting the cleaning members, the retraction means comprising an expandable split sleeve moveable between a first position on the supporting structure and a second position on the supporting structure, the one or more cleaning members being connected to the sleeve, wherein a shoulder is provided on the supporting structure at the second position which serves to radially expand the sleeve when the sleeve is located thereon such that the one or more cleaning members, in use, contact the pipeline or well casing, and wherein the sleeve is not so expanded when in the first position such that the one or more cleaning members do not contact the pipeline or well casing.

2. The apparatus as claimed in claim 1, wherein the apparatus is a well cleanup tool and the cleaning members are brushes or scraping blades.

3. The apparatus as claimed in claim 1, wherein the supporting structure comprises a generally elongated body member attachable to a work string, and includes one or more cleaning pads supporting the cleaning members.

4. The apparatus as claimed in claim 1, wherein the supporting structure and shoulder thereon are moveable relative to the sleeve during the picking up of the tool so as to move from the second position to the first position.

5. The apparatus as claimed in claim 1, further comprising locking means for locking the sleeve in the first or second position.

* * * * *